United States Patent [19]

Fujiwara et al.

[11] Patent Number: 4,808,445

[45] Date of Patent: Feb. 28, 1989

[54] COATING APPARATUS AND METHOD

[75] Inventors: Haruyoshi Fujiwara; Toshihiro Toyofuku, both of Hiroshima, Japan

[73] Assignee: Beloit Corporation, Beloit, Wis.

[21] Appl. No.: 89,473

[22] Filed: Aug. 26, 1987

[51] Int. Cl.[4] ..... B05D 1/28; B05C 1/08

[52] U.S. Cl. ..... 427/428; 118/249; 118/262; 118/414; 427/361

[58] Field of Search ..... 118/414, 249, 262, 461; 427/428, 359, 361, 364; 101/350

[56] References Cited

U.S. PATENT DOCUMENTS

| | | | |
|---|---|---|---|
| 2,729,192 | 1/1956 | Warner | 118/414 X |
| 3,245,377 | 4/1966 | Gettel | 118/249 X |
| 3,931,791 | 1/1976 | Preuss et al. | 118/249 X |

*Primary Examiner*—John McIntosh

*Attorney, Agent, or Firm*—Dirk J. Veneman; Raymond W. Campbell; David J. Archer

[57] ABSTRACT

A coating apparatus is disclosed for applying a coating material to the surface of a paper web. The coating apparatus includes a backing roll and an applicator roll which cooperates with the backing roll for defining therebetween a gap for the passage therethrough of the web. The backing roll and applicator roll counter-rotate at given speeds and a nip roll movably cooperates with the backing roll for defining therebetween a nip section. The nip section is disposed downstream relative to the gap such that the web extends progressively through the gap and through the nip section so that the coating material is applied to the surface of the web during passage of the web through the gap and nip section.

11 Claims, 2 Drawing Sheets

COATING APPARATUS AND METHOD

BACKGROUND OF THE INVENTION

1. Field of the Invention

This invention relates to a coating apparatus for coating paper or board or for applying ink in a printing machine or the like.

2. Information Disclosure Statement

In the prior art coaters, an applicator roll disposed within a coater pan has been proposed. The applicator roll counter-rotates relative to a backing roll such that coating material within the pan is carried by the applicator roll towards an application zone, or gap, disposed between the applicator roll and the backing roll. The prior art proposal includes a coating shoe which separates the coating material into two flow paths. The first flow path guides coating material between the shoe and the web extending around the backing roll. The second flow path follows the surface of the applicator roll. Excess coating material from the first flow path overflows through an overflow pipe and is recirculated.

In the prior art proposal, the gap between the applicator roll and the web extending around the backing roll ranges from 0.2 to 0.5 millimeters and the applicator roll usually rotates at a speed which is 10 to 20 percent less than the speed of the web.

As the coating material is lifted by rotation of the applicator roll towards the web, such rotation of the applicator roll generates a wedge pressure which builds up during the passage of the web through the gap between the backing roll and the applicator roll. The coating material is split into the aforementioned two flow paths, the first flow path running adjacent to the web whereas the second flow path follows the applicator roll. The point at which the aforementioned flow paths diverge constitutes a split point. Excess coating material is scraped off after the split point in order to maintain the correct amount of coating, or target coating, on the web. Such excess coating material is returned through the aforementioned overflow pipe to the coater pan.

In the prior art proposals, coated film thicknesses applied to the paper web have been in the order of 200 to 300 microns and the final film thickness after scraping the excess coating material from the web was about 20 microns. The outer surface of the coating material downstream relative to the gap and prior to removal of excess coating material by a blade constitutes an unstable, free boundary surface due to a negative pressure produced therein. Accordingly, pressure variations exist in a cross-machine direction along the width of the roll which result in the formation of coating patterns of the coating material. These coating patterns include longitudinal stripes which include a wavy, lateral cross-sectional configuration.

According to the present invention, the foregoing striped coating patterns generated by the prior art blade type coaters have reduced the quality of the resultant coated paper webs. Such coated webs not only include streaks but also split marks. The aforementioned free boundary surface is unavoidable in coaters employing two rolls. More specifically, the aforementioned striped coating pattern is caused by pressure variations in a cross-machine direction in the coating material at the aforementioned gap, or nip section. These pressure variations often result from air entrapped within the nip section.

Additionally, in the prior art two-roll coater, the pressure becomes high in the nip section and the coating material tends to penetrate the web resulting in staining of the backing roll. Therefore, it is a primary objective of the present invention to overcome the aforementioned inadequacies of the prior art proposals and to provide a coater which makes a considerable contribution to the coating art.

Another object of the present invention is the provision of a coating apparatus which includes a backing roll and an applicator roll and a nip roll movably cooperating with the backing roll for defining therebetween a nip section. The nip section is disposed downstream relative to the gap defined between the applicator and backing rolls such that the web extends progressively through the gap and through the nip section so that the coating material is applied to the surface of the web during passage of the web through the gap and nip section.

Another object of the present invention is the provision of a coating apparatus in which the gap between the backing roll and the applicator roll is variable.

Another object of the present invention is the provision of a coater apparatus in which a coater pan for the reception therein of coating material defines an opening such that the applicator roll is partially disposed within the pan so that when the applicator roll is rotated, the coating material within the pan is carried by the applicator roll from the pan towards the gap and nip section.

Another object of the present invention is the provision of a coating apparatus which includes means for moving the pan towards the backing roll.

Another object of the present invention is the provision of a coating apparatus in which an arm means rotatably supports a rotatable nip roll such that the nip roll rides on the applicator roll.

Another object of the present invention is the provision of a coating apparatus in which the nip roll is rotated by means of power means such that the nip roll rotates in the same direction of rotation as the applicator roll for applying a smooth layer of the coating material onto the web during passage of the web through the nip section, the nip roll being rotated at a speed of rotation such that accumulation of coating material thereon is inhibited.

Another object of the present invention is the provision of a coating apparatus in which the diameter of the nip roll is less than the diameter of the applicator roll and the backing roll such that during passage of the web through the nip section, the nip pressure applied between the nip roll and the backing roll is insufficient to cause penetration of the web and the resultant staining of the backing roll.

Other objects and advantages of the present invention will be apparent to those skilled in the art by a consideration of the detailed description contained hereinafter taken in conjunction with the annexed drawings.

SUMMARY OF THE INVENTION

The present invention relates to a coating apparatus and method for applying a coating material to the surface of a paper web. The apparatus includes a backing roll and an applicator roll cooperating with the backing roll for defining therebetween a gap for the passage therethrough of the web. The backing roll and the applicator roll counter-rotate at given speeds and a nip roll movably cooperates with the backing roll for defining therebetween a nip section. The nip section is disposed downstream relative to the gap such that the web extends progressively through the gap and through the nip section so that the coating material is applied to the surface of the web during passage of the web through the gap and nip section.

In a more specific embodiment of the present invention, the coating apparatus also includes a frame with the frame rotatably supporting the backing roll. The applicator roll is movable relative to the backing roll such that the gap between the backing roll and the applicator roll is variable.

The coating apparatus also includes a coater pan for the reception therein of coating material. The pan defines an opening such that the applicator roll is rotatably-disposed within the pan so that when the applicator roll is rotated, the coating material within the pan is carried by the applicator roll from the pan towards the gap and nip section.

The coating apparatus also includes moving means which is disposed between the frame and the pan for moving the pan towards the backing roll. More particularly, the moving means is an air cushion.

The coating apparatus further includes arm means having proximal and distal ends. The proximal end of the arm means is pivotally-secured to the frame and the distal end rotatably supports the nip roll such that the nip roll rides on the applicator roll.

Additionally, the coating apparatus includes power means for rotating the nip roll relative to the arm means such that the nip roll rotates in the same direction of rotation as the applicator roll for applying a smooth layer of coating material onto the web during passage of the web through the nip section. The nip roll is rotated at a speed of rotation such that accumulation of coating material thereon is inhibited.

The nip roll has a diameter which is less than the diameter of the applicator roll and the backing roll such that during passage of the web through the nip section, the nip pressure applied between the nip roll and the backing roll is insufficient to cause penetration of the web and the resultant staining of the backing roll.

The method includes the steps of rotating the applicator roll in the pan containing the coating material. The coating material is carried by the applicator roll towards the gap defined between the applicator roll and the backing roll. A nip roll is rotated in the same direction of rotation as the applicator roll with the nip roll riding on the applicator roll such that a smooth layer of coating material is applied to the surface of the web as the web extends between a nip section defined between the rotating nip roll and the cooperating backing roll.

As will be evident to those skilled in the art, many variations and modifications of the basic concept of the present invention may be made without departing from the spirit and scope of the present invention as defined by the appended claims. Although an electric motor means is shown in the preferred embodiment for rotating the nip roll relative to the arm means, it will be apparent to those skilled in the art that many means may be employed in order to obtain the desired rotation of the nip roll. Furthermore, although the present invention is particularly described with reference to a coater for coating a coating material onto a paper web, the basic concept of this invention may also be applied to the application of a layer of ink onto a printing cylinder or the like.

DETAILED DESCRIPTION OF THE DRAWINGS

Figure 1:
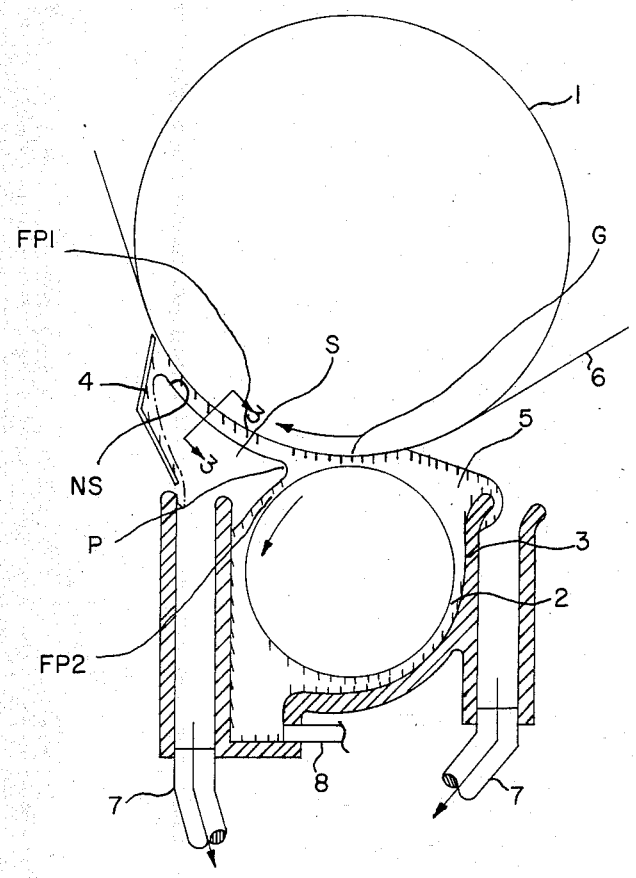
FIG. 1 PRIOR ART
FIG. 1 is a side-elevational view, partially in section, showing a prior art blade type coater apparatus.

FIG. 1 is a side-elevational view of a prior art coater apparatus which includes a rotatable backing roll 1 which cooperates with a rotatable applicator roll 2, the applicator roll 2 rotating in an opposite direction of rotation relative to the backing roll 1. A coater pan 3 houses the applicator roll 2 such that on rotation of the applicator roll 2 within the pan 3, coating material 5 within the pan 3 is carried by the applicator roll 2 towards a gap G defined between the backing roll 1 and the applicator roll 2. A nip section NS is disposed downstream relative to the gap G with the nip section NS being defined between a shoe S and the backing roll 1. The shoe S defines a split point P which divides the coating material 5 into two flow paths FP1 and FP2 respectively. Flow path FP1 flows through the nip section NS such that the coating material 5 is pressed between the shoe S and the web 6. A blade 4 scrapes excess coating material from the surface of the web 6 such that the excess coating material is fed through piping 7 and recirculated via pipe 8 into the coater pan 3.

The second flow path FP2 follows the applicator roll 2 so that coating material 5 is recirculated through the coater pan 3. Coating material 5 overflowing from the coater pan 3 upstream relative to the gap is also recirculated through piping 7 for recirculation to the coater pan 3.

Figure 2:
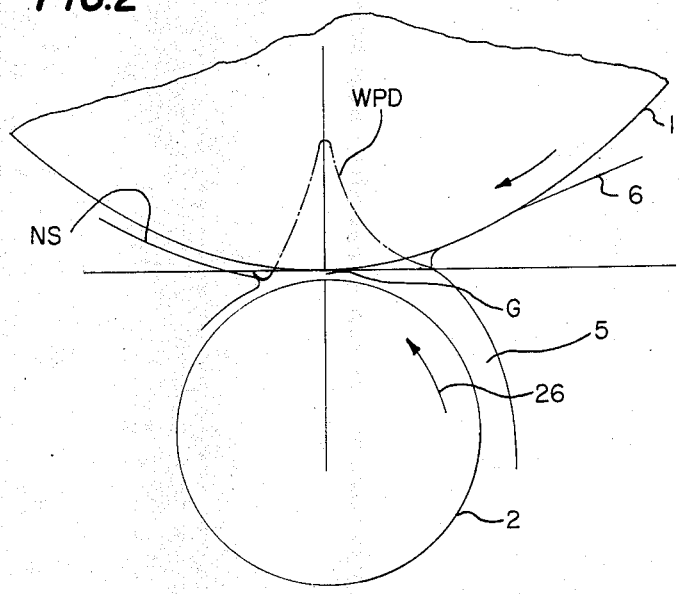
FIG. 2 PRIOR ART
FIG. 2 is an enlarged side-elevational view of the apparatus of FIG. 1 showing the nip roll, the gap between the applicator and backing roll and showing the nip section.

FIG. 2 is an explanatory drawing showing the wedge pressure distribution of the prior art apparatus of FIG. 1 as indicated by the line WPD.

Figure 3:
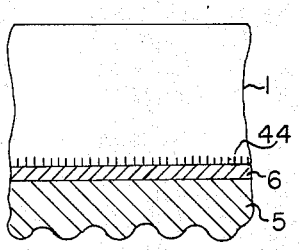
PRIOR ART FIG. 3
FIG. 3 is an enlarged sectional view taken on the line 3—3 of FIG. 1.

FIG. 3 is a sectional view taken on the line 3—3 of FIG. 1 showing the application of the coating material 5 to the web 6 and the resultant staining 44 of the backing roll 1.

FIGS. 4 to 8 show a coating apparatus generally designated 10 according to the present invention for applying a coating material to the surface of a paper web. The coating apparatus 10 includes a backing roll 12 and an applicator roll 14 which cooperates with the backing roll 12 for defining therebetween a gap G1 for the passage therethrough of the web 16. The backing roll 12 and the applicator roll 14 counter-rotate at given speeds and a nip roll 18 movably cooperates with the backing roll 12 for defining therebetween a nip section NS1 as shown particularly in FIG. 7. The nip section NS1 is disposed downstream relative to the gap G1 such that the web 16 extends progressively through the gap G1 and through the nip section NS1 so that the coating material 20 is applied to the surface of the web 16 during passage of the web 16 through the gap G1 and nip section NS1.

More specifically, the coating apparatus 10 includes a frame 22 with the frame 22 rotatably supporting the backing roll 12.

The applicator roll 14 is movable relative to the backing roll 12 such that the gap G1 between the backing roll 12 and the applicator roll 14 is variable.

The apparatus 10 also includes a coater pan 24 for the reception therein of the coating material 20. The pan 24 defines an opening 26 such that the applicator roll 14 is rotatably-disposed within the pan 24 so that when the applicator roll 14 is rotated, as shown by the arrow 27, the coating material 20 within the pan 24 is carried by the applicator roll 14 from the pan 24 towards the gap G1 and nip section NS1.

The apparatus 10 further includes moving means generally designated 28 disposed between the frame 22 and the pan 24 for moving the pan 24 towards the backing roll 12. Preferably, the moving means 28 is an air cushion 30.

Figure 6:
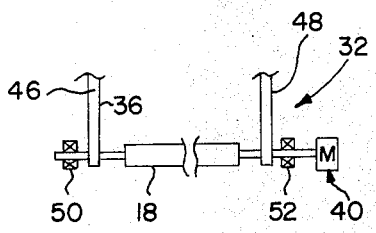
FIG. 6 is a sectional view taken on the line 6—6 of FIG. 4.

The coating apparatus 10 includes arm means generally designated 32 having a proximal and distal end 34 and 36 respectively. The proximal end 34 is pivotally-secured at 38 to the frame 22 while the distal end 36 rotatably supports the nip roll 18 as shown in FIG. 6 such that the nip roll 18 rides on the applicator roll 14.

Figure 4:
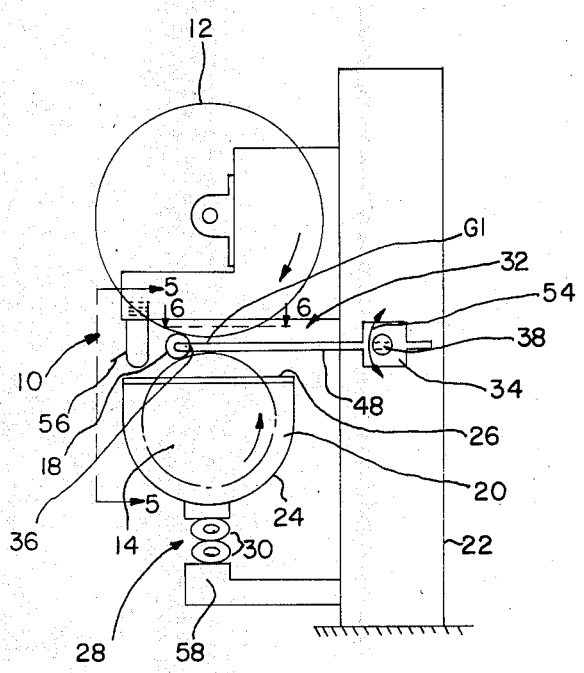
FIG. 4 is a side-elevational view of the apparatus according to the present invention.

As shown particularly in FIG. 4, power means generally designated 40 rotate the nip roll 18 relative to the arm means 32 so that the nip roll 18 rotates in the same direction of rotation as the applicator roll 14 for applying a smooth layer of the coating material 20 onto the web 16 during passage of the web 16 through the nip section NS1. The nip roll 18 is rotated at a speed of rotation such that accumulation of coating material thereon is inhibited.

Figure 5:
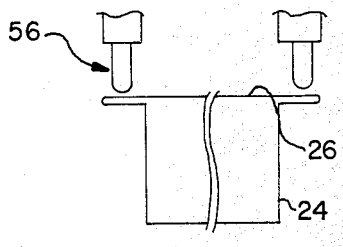
FIG. 5 is a view taken in the direction 5—5 of FIG. 4.

The nip roll 18 as shown particularly in FIG. 5 has a diameter which is less than the diameter of the applicator roll 14 and the backing roll 12 such that during passage of the web 16 through the nip section NS1, the nip pressure applied between the nip roll 18 and the backing roll 12 is insufficient to cause penetration of the web 16 and the resultant problem of staining of the backing roll 12.

Figure 7:
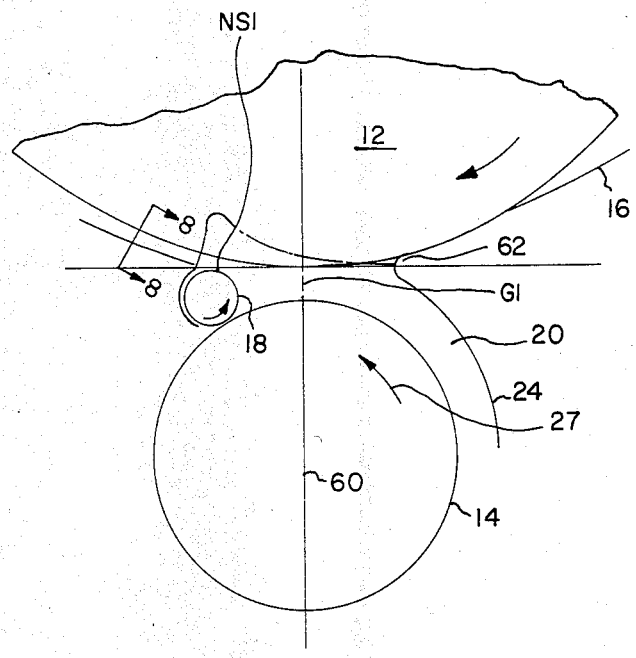
FIG. 7 is a diagramatic representation showing the applicator roll, nip roll and the backing roll and the wedge pressure distribution of the present invention as shown in FIGS. 4–6.
Figure 8:
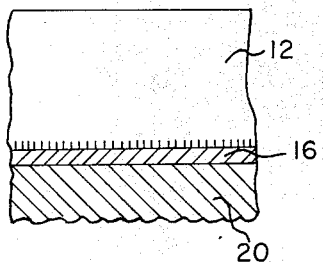
FIG. 8 is a sectional view taken on the line 8—8 of FIG. 7.

According to the present invention, FIG. 7 is a cross-sectional view of a portion surrounding the nip section NSl in a coating apparatus embodying the present invention, where the backing roll 12, the applicator roll 14, the coater pan 24, the coating material 20 and the web 16 are similar to the corresponding elements shown in the prior art proposal shown in FIG. 1. The nip roll 18 is disposed near the nip section NS1 downstream relative to the gap G1. Additionally, the nip roll 18 is rotated at a speed suitable for preventing accumulation of the coating material thereon. The nip roll 18 as shown in FIG. 6 is supported by arms 46 and 48 which protrude from the frame 22 so that the nip roll 18 can move between the backing roll 12 and the applicator roll 14. Additionally, the nip roll 18 can be driven through bearings 50 and 52 respectively, by a small capacity motor 40. The arrangement as described is given by way of example. It will be appreciated by those skilled in the art that the nip roll 18 may be driven by various means. The arms 48 and 48 as shown in FIG. 2, can be moved as indicated by the arrow 54.

In the prior art arrangement, as shown in FIG. 1, surface irregularities of the coating liquid film at the split point P are relatively large in a radial direction. Such an arrangement results in the application of a pattern to the web rather than a smooth coating. The arrangement of the present invention inhibits the prior art striped coating pattern by reducing the distance between the backing roll and the shoe by the provision of a small diameter nip roll 18 disposed near the split point of the liquid film.

Furthermore, the present invention has the advantage that the absolute value of the nipping pressure or wedge pressure distribution as indicated by the line NPD1 is lowered below the value in the prior art proposals by reducing the diameter of the nip roll 18 in order to process adequately coating material 20 having a high viscosity thereby inhibiting penetration and resultant staining of the backing roll 12. The distance between the nip roll 18 and the backing roll 12 can be adjusted by a control system (not shown) well known in the art. The aforementioned distance is adjusted for a given value by means of a sensing device generally designated 56 secured to a bracket. Such sensing device 56 cooperates with the coater pan 24 enabling vertical movement of the coater pan 24 by operation of the air cushion 30 mounted on bracket 58 installed on the frame 22 as shown in FIG. 4.

In operation of the invention as shown in FIGS. 4 to 8 the coating material 20 is lifted up by the applicator roll 14 so that the coating material 20 contacts the paper web 16 at a location which is near to the centerline 60 of the backing roll 12 and the applicator roll 14. The nipping pressure starts to build up from the contact position 62 and maintains a low absolute value in the region of the nip roll 18. Additionally, the nip width in the region NS1 is narrower than in the prior art proposals owing to the small diameter of the nip roll 18. Consequently, the nipping pressure could be lowered in absolute values for the same type of coating material. This means that the invention provides effective means for processing a coating material liable to stain the backing roll 12 by penetration through the web 16. The coating materials 20 can be applied to webs with the amount of penetration maintained at a minimum so that a coated web may be manufactured which exhibits excellent printing qualities. Additionally, surface irregularities of the coating liquid film in the radial direction of the roll at the point P is inhibited—or at least reduced so that the striping or coating pattern can be minimized.

The present invention provides a coating apparatus which avoids the prior art problems of striping and streaking shown in FIG. 3. Further, the wedge pressure can be controlled by the nip roll 18 which can be set in an arbitrary position between the backing roll 12 and the applicator roll 14. Thus, the quality of coated paper webs can be improved by the utilization of proper nipping conditions according to the type of coating material and webs being used.

What is claimed is:

1. A coating apparatus for applying a coating material to the surface of a paper web, said coating apparatus comprising:

a backing roll;

an applicator roll cooperating with said backing roll for defining therebetween a gap for the passage therethrough of the web, said rolls counter-rotating at given speeds; and a nip roll supported by said applicator roll, said nip roll movably cooperating with said backing roll for defining therebetween a nip section, said nip section being disposed downstream relative to said gap such that the web extends progressively through said gap and through said nip section so that the coating material is applied to the surface of the web during passage of the web through said gap and nip section.

2. A coating apparatus as set forth in claim 1 wherein said coating further includes:

a frame, said frame rotatably supporting said backing roll.

3. A coating apparatus as set forth in claim 1 wherein said applicator roll is movable relative to said backing roll such that said gap between said backing roll and said applicator roll is variable.

4. A coating apparatus as set forth in claim 1 further including:

a coater pan for the reception therein of the coating material, said pan defining an opening such that said applicator roll is partially disposed within said pan so that when said applicator roll is rotated, the coating material within said pan is carried by said applicator roll from said pan toward said gap and nip section.

5. A coating apparatus as set forth in claim 4 further including:

moving means disposed between said frame and said pan for moving said pan toward said backing roll.

6. A coating apparatus as set forth in claim 5 wherein said moving means is an air cushion.

7. A coating apparatus as set forth in claim 1 further including:

arm means having a proximal and a distal end, said proximal end being pivotally-secured to said frame, said distal end rotatably supporting said nip roll such that said nip roll rides on said applicator roll.

8. A coating apparatus as set forth in claim 7 further including:

powered means for rotating said nip roll relative to said arm means such that said nip roll rotates in the same direction of rotation as said applicator roll for applying a smooth layer of the coating material onto the web during passage of the web through said nip section, said nip roll being rotated at a speed of rotation such that accumulation of coating material thereon is inhibited.

9. A coating apparatus as set forth in claim 1 wherein said nip roll has a diamter which is less than the diameter of said applicator roll and said backing roll such that during passage of the web through said nip section, the nip pressure applied between said nip roll and said backing roll is insufficient to cause penetration of the web and the resultant staining of said backing roll.

10. A coating apparatus for applying a coating material to the surface of a paper web, said coating apparatus comprising:

a backing roll;

an applicator roll cooperating with said backing roll for defining therebetween a gap for the passage therethrough of the web, said rolls counter-rotating at given speeds; and a nip roll being supported by and riding on said applicator roll, said nip roll movably cooperating with said backing roll for defining therebetween a nip section, said nip section being disposed downstream relative to said gap such that the web extends progressively through said gap and through said nip section so that the coating material is applied to the surface of the web during passage of the web through the gap and nip section, said nip roll being rotated in the same direction of rotation as said applicator roll.

11. A method of applying a coating material to the surface of a paper web, said method comprising the steps of:

rotating an applicator roll within a coated pan filled with the coating material such that the coating material is carried by the applicator roll from the coater pan towards a gap defined by the applicator roll and a cooperating backing roll;

rotating a nip roll such that the nip roll rotates in the same direction of rotation as the applicator roll with the nip roll riding on the applicator roll; and moving the applicator roll relative to the backing roll such that the nip roll riding on the applicator roll defines a variable nip section between the nip roll and the cooperating backing roll so that a smooth layer of coating material is applied to the surface of the paper web during passage of the web through the nip section.

* * * * *